US008224512B1

(12) United States Patent
Dengel et al.

(10) Patent No.: US 8,224,512 B1
(45) Date of Patent: Jul. 17, 2012

(54) BACKUP METHOD FOR CONTROLLING THE OPERATION OF A MARINE VESSEL WHEN A THROTTLE LEVER IS DISABLED

(75) Inventors: Michael P. Dengel, Fond du Lac, WI (US); Gene A. Smedema, Brandon, WI (US)

(73) Assignee: Brunswick Corporation, Lake Forest, IL (US)

( * ) Notice: Subject to any disclaimer, the term of this patent is extended or adjusted under 35 U.S.C. 154(b) by 705 days.

(21) Appl. No.: 12/356,588

(22) Filed: Jan. 21, 2009

(51) Int. Cl.
*B60L 15/00* (2006.01)

(52) U.S. Cl. ..... 701/21; 701/22; 701/23; 701/27; 701/52; 701/53; 440/1; 440/5; 440/74; 440/86; 440/87; 123/399; 114/144 RE

(58) Field of Classification Search ..... 701/21, 701/115, 22, 23, 27, 52, 53, 93, 102, 200, 701/468; 440/1, 5, 74, 84, 86, 87; 123/399; 114/144 RE; 30/39.27
See application file for complete search history.

(56) References Cited

U.S. PATENT DOCUMENTS 4,464,933 A 8/1984 Santis
4,608,550 A 8/1986 Umebayashi et al.
4,687,072 A 8/1987 Komuro
4,759,732 A * 7/1988 Atsumi ..... 440/1
4,762,079 A * 8/1988 Takeuchi et al. ..... 114/152
4,792,783 A 12/1988 Burgess et al.
5,022,370 A * 6/1991 Ferguson et al. ..... 477/111
5,691,695 A 11/1997 Lahiff
6,084,510 A * 7/2000 Lemelson et al. ..... 340/539.13
6,099,367 A * 8/2000 White et al. ..... 440/5
6,109,986 A 8/2000 Gaynor et al.
6,273,771 B1 8/2001 Buckley et al.
6,280,269 B1 8/2001 Gaynor
6,382,122 B1 5/2002 Gaynor et al.
6,414,607 B1 7/2002 Gonring et al.
6,517,396 B1 2/2003 Into
6,704,643 B1 3/2004 Suhre et al.
6,885,919 B1 4/2005 Wyant et al.
7,143,363 B1 11/2006 Gaynor et al.
7,247,066 B2 7/2007 Harada et al.
2002/0076459 A1 * 6/2002 Joseph ..... 425/72.1

OTHER PUBLICATIONS

"SmartCraft Gauges" manual, published by Mercury Marine in the United States, copyright 2008.

* cited by examiner

*Primary Examiner* — James Trammell
*Assistant Examiner* — McDieunel Marc
(74) *Attorney, Agent, or Firm* — William D. Lanyi

(57) ABSTRACT

A control system is provided which allows the operator of a marine vessel to select a transmission position (e.g. forward, neutral, or reverse) and an engine speed in the event that a throttle lever malfunctions. By providing messages to the operator on an annunciator and receiving selections from the operator on a plurality of push button switches, a microprocessor selects gear positions and engine operating speed in response to commands received from the operator.

14 Claims, 4 Drawing Sheets

BACKUP METHOD FOR CONTROLLING THE OPERATION OF A MARINE VESSEL WHEN A THROTTLE LEVER IS DISABLED

BACKGROUND OF THE INVENTION

1. Field of the Invention

The present invention relates generally to a method for controlling a marine vessel and, more particularly, to a method which allows the operator of the marine vessel to make certain choices regarding operating parameters of a marine propulsion device in order to allow the vessel to be controlled even though a throttle lever has been disabled or partially disabled.

2. Background of the Invention

Those skilled in the art of marine vessels and their propulsion and control systems are familiar with many different devices that allow the operator of a is marine vessel to select a transmission gear position and engine operating speed. Typically this control is performed through the use of a throttle lever, or handle, which allows the operator to select an engine operating speed and gear position. The gear positions typically include forward, neutral and reverse gears and the engine operating speed can be selected between wide open throttle (WOT) in forward gear position and wide open throttle in reverse gear position. Some traditional throttle levers use push-pull cables that allow the operator of the marine vessel to mechanically move a throttle control mechanism and a gear selection mechanism associated with the one or more marine propulsion devices used on the marine vessel. These marine propulsion devices can be outboard motors, sterndrives, or any other suitable type of device. More recently, digital throttle and shift (DTS) systems have been developed which allow the throttle handle to be electrically connected to the throttle mechanism and gear selected mechanism without the need for actual cables to be extended between the helm and the marine propulsion devices. Certain types of control systems for marine vessels use a CAN bus to transmit commands between the throttle lever at the helm and the actual mechanisms which control the throttle position of the engine and the transmission.

In addition, many different types of displays are known to those skilled in the art for providing information to an operator of a vehicle, such as an automobile, truck, or marine vessel. The known displays typically provide information relating to the operation of the vehicle, including information relating to operational parameters such as engine speed, vehicle velocity, transmission position, and various other monitored variables associated with the operation of the vehicle and its engine.

U.S. Pat. No. 4,464,933, which issued to Santis on Aug. 14, 1984, describes a steering console providing digital readout displays. The console is intended for use with tractors and provides digital readout displays activated by a is keyboard strategically located within easy finger reach of the operator. A multitude of vital tractor functions are automatically continuously monitored and, simply by touch of appropriate colored switch pads on the keyboard, the operator at will changes the digital displays to the different functions he desires to read.

U.S. Pat. No. 4,608,550, which issued to Umebayashi et al. on Aug. 26, 1986, describes an electric signal transmission system on a road vehicle. Signals between a control board mounted on a steering wheel, but held in stationary state irrespective of a rotation of the steering wheel, and an electric controller disposed at a position remote from a steering mechanism are described. The control board is supported by a steering driveshaft through a toothed wheel mechanism, so that it remains stationary regardless of a rotation of the shaft.

U.S. Pat. No. 4,687,072, which issued to Komuro on Aug. 18, 1987, describes an instrument display system for a motorcycle. It displays various vehicle monitoring readings having a lightweight liquid crystal plate element mounted on the vehicle front within easy view of the motorcycle operator and a control unit for the plate element mounted closer to the motorcycle's center of stability.

U.S. Pat. No. 4,792,783, which issued to Burgess et al. on Dec. 20, 1988, describes a vehicular function controller having alterable function designators. It includes a plurality of switches, each switch adapted to control a plurality of vehicular functions. Each switch has associated therewith a display element for indicating which of the functions that switch is controlling. The switch further includes a microprocessor based controller which mediates which designator each display element will exhibit as well as which vehicular function a given switch will control. The system is readily adapted to a menu-driven mode of operation, and the switches may be mounted upon the steering wheel of a vehicle.

U.S. Pat. No. 5,691,695, which issued to Lahiff on Nov. 25, 1997, describes a vehicle information display on a steering wheel surface. The wheel is provided with a thin reconfigurable display such as an LED, an LCD, an electroluminescent display, or other types of reconfigurable thin displays. Vehicle instrument information such as speedometer, fuel level, vehicle temperature, engine speed, etc. is provided on this display.

U.S. Pat. No. 6,109,986, which issued to Gaynor et al. on Aug. 29, 2000, discloses an idle speed control system for a marine propulsion system. It controls the amount of fuel injected into the combustion chamber of an engine cylinder as a function of the error between a selected target speed and an actual speed. The speed can be engine speed measured in revolutions per minute or, alternatively, it can be boat speed measured in nautical miles per hour or kilometers per hour. By comparing target speed to actual speed, the control system selects an appropriate pulse width length for the injection of fuel into the combustion chamber and regulates the speed by increasing or decreasing the pulse width.

U.S. Pat. No. 6,273,771, which issued to Buckley et al. on Aug. 14, 2001, discloses a control system for a marine vessel. It incorporates a marine propulsion system that can be attached to a marine vessel and connected in signal communication with a serial communication bus and a controller. A plurality of input devices and output devices are also connected in signal communication with a communication bus and a bus access manager, such as a CAN Kingdom network, is connected in signal communication with a controller to regulate the to incorporation of additional devices to the plurality of devices in signal communication with the bus, whereby the controller is connected in signal communication with each of the plurality of devices on the communication bus.

U.S. Pat. No. 6,280,269, which issued to Gaynor on Aug. 28, 2001, discloses an operator display panel control by throttle mechanism switch manipulation. It is provided with a plurality of buttons and a control unit that interprets the state of the various buttons and switches in different ways, depending on the state of a first operating parameter. The first operating parameter can be the gear selector position or the status of a manual selector switch or push button.

U.S. Pat. No. 6,382,122, which issued to Gaynor et al. on May 7, 2002, discloses a method for initializing a marine vessel control system. An auto detect system is provided for a marine vessel in which the various associations and relationships between marine propulsion devices, gauges, sensors, and other components are quickly and easily determined. The system performs a method which automatically determines the number of marine propulsion devices on the marine vessel and, where needed, prompts the boat builder or marine vessel outfitter to enter various commands to identify particular marine propulsion devices with reference to their location on the marine vessel and to identify certain other components, such as gauges, with reference to both their location at a particular helm station and their association with a particular marine propulsion device.

U.S. Pat. No. 6,414,607, which issued to Gonring et al. on Jul. 2, 2002, discloses a throttle position sensor with improved redundancy and high resolution. The sensor is provided with a plurality of sensing elements which allow the throttle position sensor to provide a high resolution output to measure the physical position of a manually movable member, such as a throttle handle, more accurately than would otherwise be possible. The plurality of sensor significantly increases the redundancy of the sensor and allows its operation even if one of the sensing elements is disabled.

U.S. Pat. No. 6,517,396, which issued to Into on Feb. 11, 2003, describes a boat speed control. The boat includes a motor having a throttle control lever coupled to a throttle of the motor and provides for stable and predictable control of the speed of the boat. The control system includes a position detector configured to detect the position of the throttle control lever and to generate a first signal representative of a target speed of the motor. It also includes a sensor which generates a second signal representative of the actual speed of the motor and an actuator is adapted to control the throttle. A servo controller generates an output to adjust the position of the actuator.

U.S. Pat. No. 6,704,643, which issued to Suhre et al. on Mar. 9, 2004, discloses an adaptive calibration strategy for a manually controlled throttle system. The procedure involves the steps of manually placing a throttle handle in five preselected positions that correspond with mechanical detents of the throttle control mechanism. At each of the five positions, one or more position indicating signals are received by a microprocessor of a controller and stored for future use. The five positions comprise wide open throttle (WOT) in forward gear, wide open throttle in reverse gear, the shift position between neutral and forward gear, the shift position between neutral and reverse gear, and the midpoint of the neutral gear selection range.

U.S. Pat. No. 6,885,919, which issued to Wyant et al. on Apr. 26, 2005, discloses a method for controlling the operation of a marine vessel. A process is provided by which the operator of a marine vessel can invoke the operation of a computer program that investigates various alternatives that can improve the range of the marine vessel. The distance between the current location of the marine vessel and a desired way point is determined and compared to a range of the marine vessel which is determined as a function of available fuel, vessel speed, fuel usage rate, and engine speed.

U.S. Pat. No. 7,143,363, which issued to Gaynor et al. on Nov. 28, 2006, discloses a method for displaying marine vessel information for an operator. The method selects a chosen visual display based on the magnitudes of is one or more vessel-related parameters, such as engine speed, gear selector position, or vessel velocity. Based on the selected marine vessel operating condition, the chosen visual display is selected and the contents of that chosen visual display are presented on an information display device, such as a liquid crystal display or other type of monitor.

U.S. Pat. No. 7,247,066, which issued to Harada et al. on Jul. 24, 2007, describes a remote operation system for an outboard motor. It includes a remote control box installed at a cockpit of the boat and a lever attached to a support shaft that is rotatably accommodated in the remote control box for being manipulated by an operator. It also comprises a plurality of sensors, such as a potentiometer and a rotary encoder provided to generate outputs indicative of an angle of rotation of the support shaft through the lever manipulation, respectively, and a control unit which controls operation of a throttle actuator and a shift actuator based on at least one of the outputs of the sensor. It thereby improves reliability and enables continued regulation of throttle opening and change of shift position even if a failure occurs in one of the sensors.

Information relating to the types of gauges with which the present invention can be used is provided in a document titled "SmartCraft Gauges" published by Mercury Marine in the United States with a copyright notice of 2008. Although many other types of gauges and displays can be used in alternative embodiments of the present invention, the gauges shown in this manual are particularly adaptable for use with a preferred embodiment of the present invention.

The patents described above are hereby expressly incorporated by reference in the description of the present invention.

In current types of engine control systems which use electrical signals, between a throttle handle and components which actually change parameters of the engine, various types of sensors in the throttle handle are typically used to create the signals which allow a microprocessor to make the appropriate adjustments to change parameters regarding the engine's operation. If a failure occurs with one of the sensors, the operator of a marine vessel may be deprived of any practical way to control the operation of the engine so that the marine vessel can be taken to a place where appropriate repairs can be made. It would therefore be significantly beneficial if a control system for a marine vessel could provide a system that allows the operator of the marine vessel alternative methods for controlling the operation of a marine propulsion device in a manner that is sufficient to allow the marine vessel to be driven to a place where the malfunctions can be corrected. It would also be significantly beneficial if this type of control system could be provided without the need for additional equipment which could significantly increase the cost of the marine propulsion system.

SUMMARY OF THE INVENTION

A method for controlling the operation of a marine propulsion device, in accordance with a preferred embodiment of the present invention, comprises the steps of providing a manually operable handle which is configured to control the operation of the marine propulsion device, recognizing a fault condition associated with the manually operable handle, providing an annunciator, providing a plurality of switches, transmitting a message with the annunciator for receipt by an operator of the marine propulsion device, receiving an input signal from at least one of the plurality of switches activated by the operator, and changing an operating parameter of the marine propulsion device in response to the input signal.

In one embodiment of the present invention, the operating parameter is a gear selection associated with a transmission of the marine propulsion device. In another embodiment, the operating parameter is an operating speed of an engine of the marine propulsion device. The fault condition can relate to a position signal which is responsive to a position of the manually operable handle. The recognizing step can comprise the step of receiving the position signal and comparing the position signal to a preselected range of magnitudes of the position signal which are considered to be acceptable. The annunciator can comprise a liquid crystal display device and the plurality of switches can comprise at least one push button. The manually operable handle can be a throttle handle.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
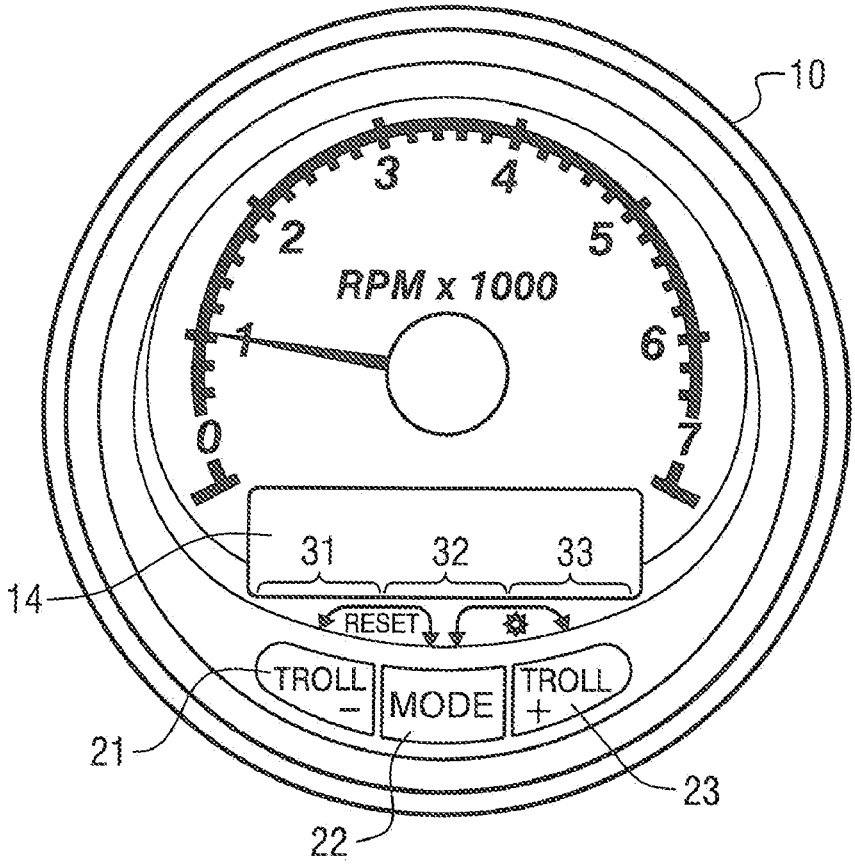
FIG. 1 PRIOR ART
FIG. 1 illustrates a gauge that is generally known to those skilled in the art.

Throughout the description of the preferred embodiment of the present invention, like components will be identified by like reference numerals.

FIG. 1 shows an exemplary type of gauge that can be used in conjunction with a marine vessel. The particular gauge illustrated in FIG. 1 is a tachometer that allows the operator of a marine vessel to monitor the operating speed of one or more engines. The gauge illustrated in FIG. 1 is generally familiar to those skilled in the art of marine propulsion systems. Alternatively, a speedometer or other type of gauge can be used in conjunction with various embodiments of the present invention. In addition, operation of certain embodiments of the present invention need not use a gauge for these purposes. In alternative embodiments of the present invention, a simple set of push buttons and a display device acting as an annunciator can be used in order to allow the operator of a marine vessel to communicate certain desired operating parameters, relating to the operation of the engine, to a microprocessor that is configured to control the engine according to those received parameters from the operator of the marine vessel.

With continued reference to FIG. 1, the gauge 10 is provided with an annunciator 14 which can be a liquid crystal device (LCD). It also comprises a plurality of switches, 21-23, by which the operator can enter certain selections. In conjunction with a tachometer, such as gauge 10 in FIG. 1, the three switches can be used to allow the operator of a marine vessel to make various mode selections, as with switch 22, and also allow the operator to decrease or increase the trolling speed of an engine with buttons 21 and 23, respectively. It should also be understood that the switches, 21-23, can be used in combination with each other to select certain other options. For example, as illustrated in FIG. 1, the operator can choose a reset action if switches 21 and 22 are pressed simultaneously. Simultaneous actuation of the switches, 21-23, in most embodiments of the present invention, are not required.

Figure 2:
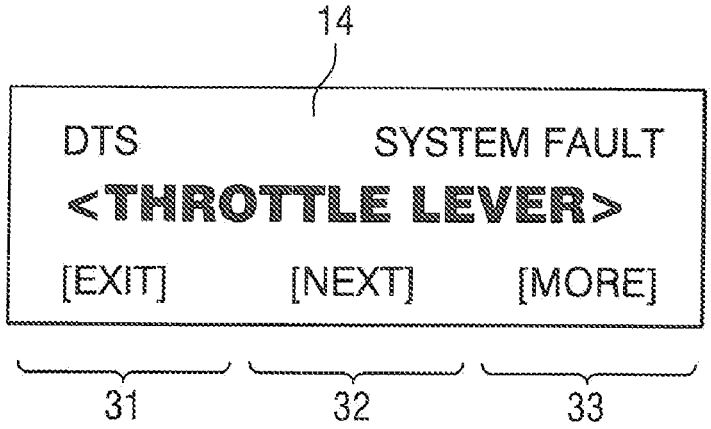
FIG. 2 is an exemplary annunciator message associated with a preferred embodiment of the present invention.

The annunciator 14 has three areas, 31-33, or zones identified in FIG. 1 at the bottom portion of the LCD display. Those three areas, when used in conjunction with the present invention, are used to associate certain optional choices with specific ones of the plurality of switches, 21-23. FIG. 2 shows an exemplary use of the annunciator 14 to provide output information for receipt by the operator of the marine vessel and to identify certain options associated with the switches described above. As an example, in FIG. 2, the operator is notified that a digital throttle and shift (DTS) system fault has occurred and it relates to the throttle lever. In addition, on the LCD display, the operator is given three optional choices of "EXIT", "NEXT", and "MORE". These are shown in regions 31-33, respectively, of the LCD display and relate to the three switches, 21-23, described above in conjunction with FIG. 1. FIG. 2 is intended as an illustration of how a general type of output message appears on the annunciator 14.

Figure 3A:
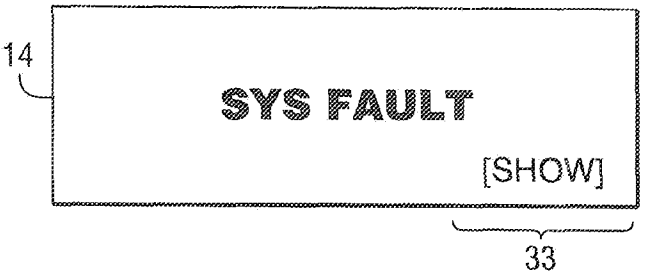
FIGS. 3A-3F show various types of annunciator displays and potential operator responses used in a preferred embodiment of the present invention.
Figure 3B:
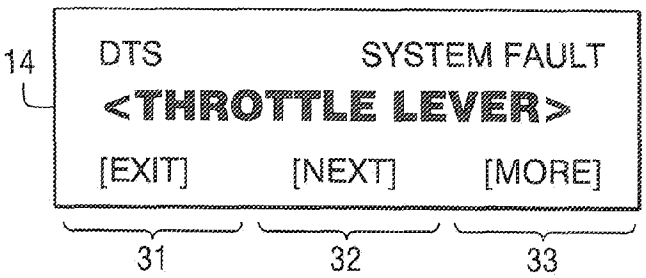
Figure 3C:
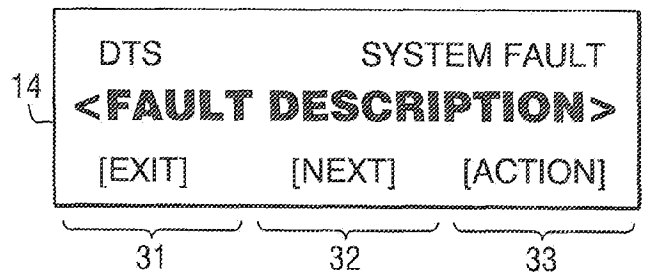
Figure 3D:
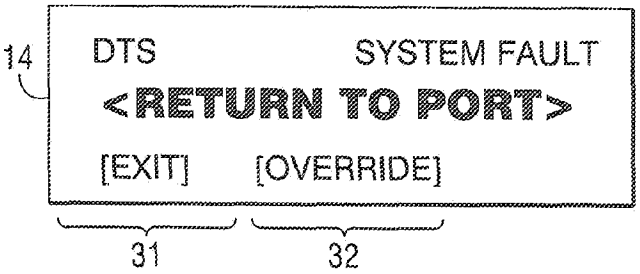
Figure 3E:
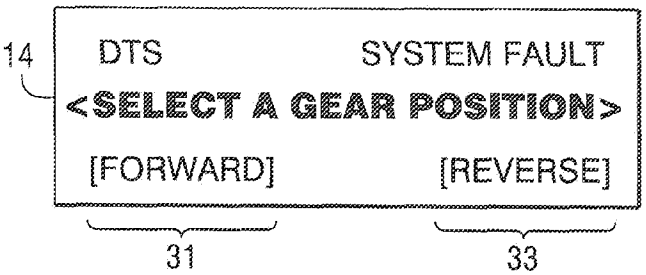
Figure 3F:
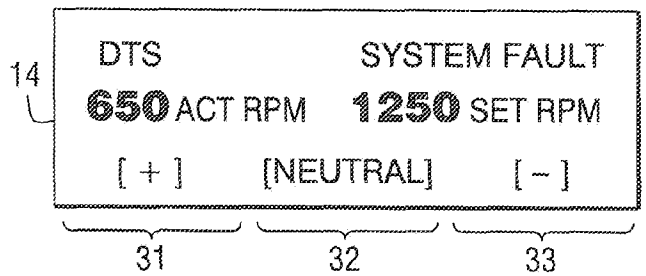

FIGS. 3A-3F show various different types of displays that can be provided on the annunciator 14 for viewing by the operator of a marine vessel. It should be understood that the particular appearance and the words used to communicate with the operator in the event of a throttle lever fault are not limiting to the present invention. FIGS. 3A-3F are intended only as exemplary illustrations of certain hypothetical displays that can be used in conjunction with certain preferred embodiments of the present invention. A hypothetical scenario will be used in conjunction with FIGS. 1 and 3A-3F to specifically illustrate how the present invention can be used in the event that a malfunction occurs in conjunction with the throttle lever of a marine vessel. If a lever fault occurs, a microprocessor that controls the operation of an engine can typically be programmed to automatically shift into neutral gear and place the engine at idle speed. Then, the fault screen shown in FIG. 3A would appear. The operator is then asked to press switch 23, as described above in conjunction with FIG. 1, because of the message in zone 33 of the annunciator 14. Then, as shown in FIG. 3B, scrolling text would identify the component which is the source of the recognized problem. If the operator presses switch 22 in response to "NEXT" in zone 32 of the annunciator 14, the system would display the next fault condition if one exists. Pressing switch 23 associated with "MORE" in zone 33 will display a more detailed description of the fault. With reference to FIG. 3C, scrolling text would then explain in detail the description of the fault. Three more optional actions are provided at zones 31-33. By pressing switch 23, as described above in conjunction with FIG. 1, the operator selects "ACTION" which displays the course of action required by the operator. The system could then display the image shown in FIG. 3D with scrolling text that displays the course of action required by the operator. The system could then display the image shown in FIG. 3D with scrolling text that displays the course of action required by the operator. By pressing switch 22 as described above in conjunction with FIG. 1, the operator chooses the "OVERRIDE" selection shown in zone 32 and this will cause the system to display an image which will allow the operator to select a gear and throttle lever. FIG. 3E will ask the operator to select a gear position. With reference to FIGS. 1 and 3E, pressing switch 21 will select a forward gear position and pressing switch 23 will select a reverse gear position. It is assumed that when the display shown in FIG. 3E appears, the system had already placed the engine in a neutral gear position. After the transmission is appropriately addressed, the display shown in FIG. 3F will ask the operator to either increase or decrease the engine speed by using switches 21 or 23, respectively, in conjunction with display zones 31 and 33 as described above in conjunction with FIG. 1. In most embodiments of the present invention, the flexibility to change the operating speed of the engine will be limited according to certain ranges in order that the operator does not operate the marine vessel at excessive speeds during this fault condition. If the operator presses switch 22, which indicates "NEUTRAL" in zone 32, the engine will immediately shift into neutral gear and decrease throttle position to idle and the system will return to the display screen shown in FIG. 3E. The operator once again has the ability to select a gear position other than neutral. Although the sequences described above in conjunction with FIGS. 1 and 3A-3F do not describe each possible variation and each possible response that the operator may have upon receipt of the various display screens, it is illustrative of the manner in which the present invention allows the operator to control the basic operation of the marine vessel by selecting the transmission position and engine speed without the need for a throttle lever which is disabled.

Figure 4:
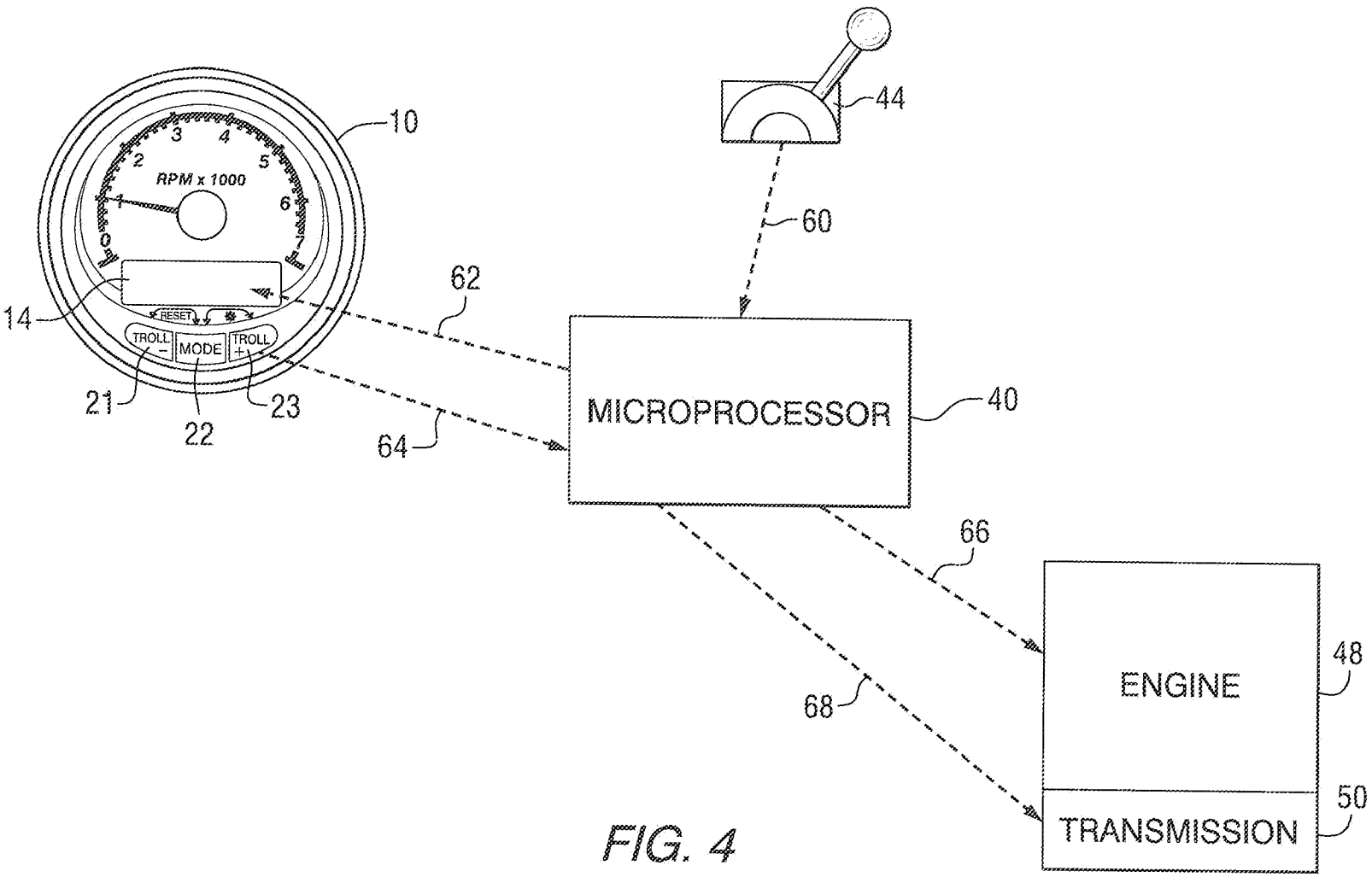
FIG. 4 is a basic simplified diagram of a marine propulsion system that is usable in conjunction with the present invention.

FIG. 4 is a schematic representation of the basic components used in a preferred embodiment of the present invention. The gauge 10, with its annunciator 14 and switches, 21-23, is connected in signal communication with a microprocessor 40. The microprocessor 40 is connected in signal communication with a throttle lever structure 44. It is also connected in signal communication with various control devices of an engine 48 and a transmission 50 of a marine propulsion device. A sequence of operation might begin with the microprocessor 40 interrogating signals 60 from the throttle lever 44 to assure that those signals are within acceptable ranges. The microprocessor 40 is configured to be able to output messages 62 to the annunciator 14 and receive signals 64 from the switches, 21-23. The microprocessor 40 is also configured to control the operating speed of the engine 48, as represented by dashed line 66, and control the gear position 68 of the transmission 50. If the microprocessor 40 determines that the signals on line 60 represent a malfunction of the throttle lever 44, it can begin to display messages on the annunciator 14 as represented by dashed line 62. Those messages were described above in conjunction with FIGS. 1, 2 and 3A-3F. The switches, 21-23, allow the operator to provide responses on line 64 to the microprocessor 40. In response to the signals received from the switches, the microprocessor 40 controls the speed of the engine 48 and the gear position of the transmission 50.

Figure 5:
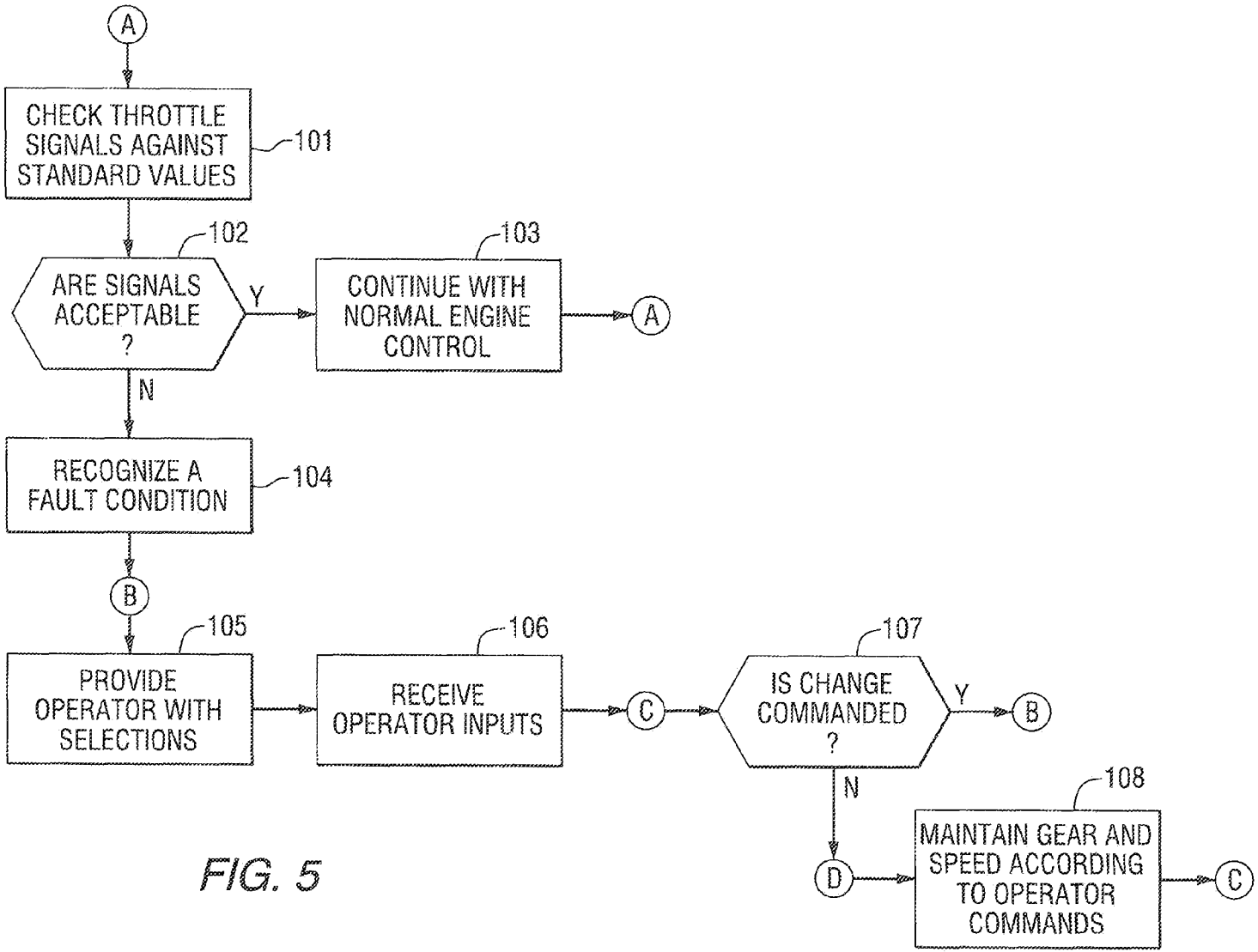
FIG. 5 shows an exemplary flowchart that can be used to implement the basic concepts of the present invention.

FIG. 5 shows a simplified flow chart that shows a typical way that the microprocessor 40 can implement the operation of the present invention. With reference to FIGS. 4 and 5, beginning at point A the microprocessor checks the throttle signals 60 against standard values or ranges as represented by functional block 101. If the signals are acceptable, as determined at functional block 102, the system continues with normal engine control as illustrated at functional block 103 and then returns to point A. If the signals are not acceptable, a fault condition is recognized at functional block 104 and the system proceeds, at point B, to provide the operator with selections as shown in functional block 105, and described above in conjunction with FIGS. 3A-3F. Operator inputs are received at functional block 106 from the switches, 21-23, and the system proceeds to point C where it determines if a change is commanded at functional block 107. If a change is commanded, the program proceeds to point B in order to update a new image on the annunciator 14. If a change is not commanded, it proceeds to point D and maintains the gear and speed according to the operator commands at functional block 108. It then returns to point C to determine whether or not a new change is received.

With reference to FIGS. 1, 2, 3A-3F, 4 and 5, a preferred embodiment of the present invention comprises the steps of providing a manually operable handle 44 which is configured to control the operation of the marine propulsion device, 48 and 50. It recognizes a fault condition associated with the manually operable handle 44 and provides an annunciator 14 along with a plurality of switches, 21-23. It transmits messages with the annunciator 14 for receipt by an operator of the marine propulsion device. It receives an input signal from at least one of a plurality of switches, 21-23, activated by the operator and changes in operating parameter of the marine propulsion device in response to the input signal 64. The operating parameter can be a gear selection associated with a transmission 50 of the marine propulsion device or an operating speed of an engine 48 of the marine propulsion device. The fault condition can relate to a signal which is responsive to a position of the manually operable handle. Systems of this type are described in the patents noted above in the "Background of the Invention" section. The recognizing step can comprise the steps of receiving the signal from the throttle lever and comparing the signal to a preselected range of magnitudes of the signal that are known to be acceptable. The annunciator can comprise a liquid crystal display device and the plurality of switches can comprise at least one push button. The manually operable handle, as described above, can be a throttle handle.

Although the present invention has been described with particular detail and illustrated to show a preferred embodiment, it should be understood that alternative embodiments are also within its scope.

We claim:

1. A method for controlling the operation of a marine propulsion device, comprising the steps of:

providing a manually operable handle which is configured to control operation of said marine propulsion device;

recognizing a fault condition associated with said manually operable handle;

providing an annunciator;

providing a plurality of switches;

transmitting a message with said annunciator for receipt by an operator of said marine propulsion device;

receiving an input signal from at least one of said plurality of switches activated by said operator; and changing an operating parameter of said marine propulsion device in response to said input signal, wherein said fault condition relates to a position signal which is responsive to a position of said manually operable handle and wherein said recognizing step comprises the steps of receiving said position signal and comparing said position signal to a preselected range of magnitudes of said position signal.

2. The method of claim 1, wherein:

said operating parameter is a gear selection associated with a transmission of said marine propulsion device.

3. The method of claim 1, wherein:

said operating parameter is an operating speed of an engine of said marine propulsion device.

4. The method of claim 1, wherein:

said annunciator comprises a liquid crystal display device.

5. The method of claim 1, wherein:

said plurality of switches comprises at least one push button.

6. The method of claim 1, wherein:

said manually operable handle is a throttle handle.

7. A method for controlling the operation of a marine propulsion device, comprising the steps of:

providing a manually operable handle which is configured to control operation of said marine propulsion device;

recognizing a fault condition associated with said manually operable handle;

providing a visually readable annunciator;

providing a plurality of push buttons;

transmitting a message with said annunciator for receipt by an operator of said marine propulsion device;

receiving an input signal from at least one of said plurality of push buttons activated by said operator; and changing an operating parameter of said marine propulsion device in response to said input signal, wherein said fault condition relates to a position signal which is responsive to a position of said manually operable handle and wherein said recognizing step comprises the steps of receiving said position signal and comparing said position signal to a preselected range of magnitudes of said position signal.

8. The method of claim 7, wherein:

said manually operable handle comprises a plurality of resistive elements, said position signal being generated in response to a position of said manually operable handle relative to said plurality of resistive elements.

9. The method of claim 7, wherein:

said annunciator comprises a liquid crystal display device.

10. The method of claim 7, wherein:

said manually operable handle is a throttle handle.

11. The method of claim 7, wherein:

said operating parameter is a gear selection associated with a transmission of said marine propulsion device.

12. The method of claim 11, wherein:

said operating parameter is an operating speed of an engine of said marine propulsion device.

13. A method for controlling the operation of a marine propulsion device, comprising the steps of:

providing a manually operable handle which is configured to control operation of said marine propulsion device;

providing an annunciator;

providing a plurality of switches;

transmitting a message with said annunciator for receipt by an operator of said marine propulsion device;

receiving an input signal from at least one of said plurality of switches activated by said operator;

changing an operating parameter of said marine propulsion device in response to said input signal;

recognizing a fault condition associated with said manually operable handle, wherein said operating parameter is a gear selection associated with a transmission of said marine propulsion device, said fault condition relating to a position signal which is responsive to a position of said manually operable handle, said annunciator comprising a liquid crystal display device, said recognizing step comprising the steps of receiving said position signal and comparing said position signal to a preselected range of magnitudes of said position signal, said plurality of switches comprising at least one push button.

14. The method of claim 13, wherein:

said operating parameter is an operating speed of an engine of said marine propulsion device.

* * * * *